US005791560A

United States Patent [19]

Rogers et al.

[11] Patent Number: 5,791,560

[45] Date of Patent: Aug. 11, 1998

[54] METHOD AND APPARATUS FOR SPRAYING METAL TO FORM A COATING

[75] Inventors: Alan R. Rogers; Richard W. Goessman, both of Bremerton; Frank S. Rogers, Silverdale, all of Wash.

[73] Assignee: Thermion, Inc., Silverdale, Wash.

[21] Appl. No.: 762,190

[22] Filed: Dec. 9, 1996

[51] Int. Cl.[6] ..... B05B 1/24; B05C 5/04

[52] U.S. Cl. ..... 239/8; 239/80; 239/84

[58] Field of Search ..... 239/80, 83, 84, 239/290, 299, 8; 219/76.14

[56] References Cited

U.S. PATENT DOCUMENTS

| | | | |
|---|---|---|---|
| 4,492,337 | 1/1985 | Harrington et al. | 219/76.14 X |
| 4,512,513 | 4/1985 | Rogers | 239/83 X |
| 4,624,410 | 11/1986 | Rogers . | |
| 5,254,359 | 10/1993 | Zureck et al. | 219/76.14 X |
| 5,308,409 | 5/1994 | Kamimura et al. | 219/76.14 X |

FOREIGN PATENT DOCUMENTS

| | | | |
|---|---|---|---|
| 300513 | 1/1989 | European Pat. Off. | 239/84 |
| 4-59186 | 2/1992 | Japan | 219/76.14 |
| 1419738 | 8/1988 | U.S.S.R. | 239/83 |

*Primary Examiner*—Kevin Weldon

*Attorney, Agent, or Firm*—Steven P. Koda

[57] ABSTRACT

An arc spray bead for uniformly distributing molten metal. The head includes a pair of contact tips, a primary nozzle and a plurality of side nozzles. Wire is fed through the contact tips into an arc zone where the wire tips are melted. The plurality of side nozzles are located adjacent to the contact tips downstream from the primary nozzle. The primary nozzle blows the molten metal into the stream of the side nozzles. The nozzles atomize, cool and uniformly distribute the molten metal into a desired spray pattern. During spraying the feed wires are moved forward. Initially upon discontinuing the spraying, the feed wires are retracted in part to prevent fusing of the wire leads.

21 Claims, 4 Drawing Sheets

METHOD AND APPARATUS FOR SPRAYING METAL TO FORM A COATING

BACKGROUND OF THE INVENTION

This invention relates to a method and apparatus for arc spraying wire to form a metal coating on a work surface, and more particularly to a method and apparatus for atomizing, cooling and uniformly distributing molten metal.

Zinc, aluminum or other metal coatings are applied in large construction projects in lieu of a paint coating to prolong the life of an underlying surface. The anti-corrosion properties of zinc and aluminum are particularly desirable. Application of a metal coating provides a durable finish for oil riggings, metal bridges, concrete bridges, buildings and other large construction projects. A metal coating has a useful life of approximately 25–40 years. This is substantially longer than the approximately 10 year useful life for a coat of paint. The specific life of a coating depends on the environment in which the coating is exposed. Even when a coat of paint is applied over a metal coating for color or other decorative purpose, the metal coating protects the underlying work surface. For example, when the paint chips away, any corrosion effects are directed to the metal coating rather than the underlying work surface. Thus, the work surface is protected for the longer useful life of the metal coating. For concrete bridges the metal coating serves as a sacrificial anode forming a path of lower resistance than the re-bar supports within the concrete. As a result, the electrical currents known to decay the rebar in concrete bridges are in part redirected to the metal coating.

Metal coatings also are used in the appliance, tooling and machining industries to provide a strong and durable surface. The application of metal coatings over a large surface area, however, has special challenges to which this invention is directed.

Arc spraying of metal is commonly used for applying a metal coating over a large surface area. Arc spraying enables a higher deposition rate and larger coverage area than the radiating spray methods used for small surface areas (e.g., on the order of square inches or less) and the sputtering of miniature surface areas (e.g., on the order of microns). In the field of arc spraying an electric arc is established between two consumable metal wires, referred to as electrodes. These electrodes melt resulting in molten metal which is distributed onto a work surface. U.S. Pat. No. 4,512,513 issued Apr. 23, 1985 discloses an arc spray method and apparatus in which shorting of the feed wires is detected to avoid system failures. Voltage across the electrodes is detected so that when a short occurs, a voltage sensor detects such occurrence. To avoid a system failure the voltage signal and wire feeding is temporarily stopped until the short melts.

Conventional arc spraying systems use feed wires of a diameter up to ⅛ inch (3.175 mm). Typically two feed wires are fed into respective contact tips which route current into the feed wires. The tips are oriented toward each other so that the wires extend toward an intersection. An air gap typically occurs between the wires with contact between the wires being undesirable. A high power is applied across the wires causing an electrical arc to form across the tips. The power melts the feed wire portions in the arc zone. A nozzle is located adjacent to the contact tips and oriented to emit an air stream toward the arc zone. The air stream sprays the molten metal toward the work surface to be coated. The power applied to the wires is limited according to the size of the wire. A typical welding machine puts out approximately 50 volts. During arc spraying the operating voltage is between 18 volts and 40 volts, with approximately 28 volts a normal operating voltage. Thus, voltage is within a limited voltage range. As a result, current is varied to vary the power level.

It has been believed that the throughput in kilogram per hour forming a metal coating depends almost entirely on the amount of current being used, regardless of the wire size. Thus, to improve throughput one would increase the current. Wire, however, is limited in how much current can be passed based upon the wire's diameter. For example, a ⅛ inch diameter wire will carry up to 1000 amps, and a 1/12 inch diameter wire only carry approximately 300 amps. According to such belief, there would be no advantage in increasing wire diameter if the current remains the same. This invention, however, is directed toward a system for effectively spraying wires of larger diameter at lower power. Previously, it has not been known to effectively arc spray metal wires in excess of a ⅛ inch diameter for successful commercial applications.

SUMMARY OF THE INVENTION

According to the invention, a low energy high deposition arc spray system is achieved in which for the same power level larger wires produce higher deposition. The arc spray system includes an arc spray head for uniformly distributing molten metal from feed wires. The spray head includes a pair of contact tips, a primary nozzle and a plurality of side nozzles. A metal wire is fed through each contact tip to define respective electrodes. The wires are fed toward an intersection so that an electrical arc bridges across the wire ends (i.e., the electrodes) during operation. Electrical current into the electrodes and across the arc melts a portion of the exposed electrodes. The primary nozzle is located behind the contact tips and oriented toward the intersection. Air under pressure flows through the primary nozzle blowing the molten metal from the arc zone.

According to one aspect of this invention, a plurality of side nozzles are located down stream from the primary nozzle adjacent to the contact tips. The side nozzles also emit air under pressure and serve to atomize, cool and shape the molten metal into a desired spray pattern. The side nozzles distribute the molten metal uniformly within the spray pattern.

One function of the side nozzles is to partially cool the molten metal so as to reduce oxidation, fumes, smoke and burn off of the metal. As a result deposit efficiency is increased. The deposition process also is more effective in some applications where the cooling produces stronger bonding between the work surface and the metal coating. Accordingly, one advantage of the invention is improved deposition efficiency and effectiveness. The side nozzles enable uniform distribution of molten metal. In particular the side nozzles enable uniform distribution of molten metal from larger wires, (e.g., >⅛ inch). The larger volume of metal enables an increased deposition rate and a larger spray pattern. Uniform spray patterns spanning 12 inches (30.5 cm) in width have been achieved according to embodiments of this invention for wires having a diameter between ⅛ inch (3.175 mm)and 3/16 inch (4.7625 mm).

According to another aspect of the invention, the feed wires are controlled so as to avoid fusing when spraying discontinues. When the spraying stops temporarily, the feed wires begin to cool. Molten metal in the arc zone not blown downstream cools in place. Previously, the cooling at times resulted in the two feed wires mechanically joining together in the arc zone. Once the electrical current is reactivated such joined configuration embodies an electrical short. For conventional methods using wires less than or equal to ⅛ inch in diameter, the initial current upon restarting often would blow out the shorted region where the wires intersect before damage occurred to the system. For larger diameter wires (e.g., larger than ⅛ inch diameter), the wire resistance is too great for the shorted region to be blown out. As a result, damage to the system (e.g., burn off of the contact tips) could occur. To avoid such fusing of the feed wires, it is an aspect of this invention that the feed wires be drawn backward upon discontinuation of the spraying process. A wire feeding mechanism moves the feed wires in both forward and reverse direction during operation of the arc spraying system. During spraying the feed wires are moved forward into the contact tips with the lead portions being melted and sprayed. Initially upon stopping, the feed wires are retracted in part to prevent fusing of the wire leads. The advantage of drawing the feed wires backward is that when the molten metal cools the feed wires are not joined, but instead are separated by an air gap. Subsequently, when the spraying continues, there is no short. To continue the spraying process the wires are fed forward, current is fed through the wires, and an electrical arc forms across the wires as desired.

According to another aspect of this invention a uniform fan spray is achieved by applying two sets of side nozzles. A first set forms a semi-circular pattern to one side of the primary nozzle stream. A second set forms another semi-circular pattern to the an opposite side of the primary nozzle stream. The side nozzles are angled to disperse the molten metal uniformly within a spray pattern.

According to a preferred embodiment of the invention, an arc spray head includes a plurality of first nozzle ports oriented in a first direction for emitting a first gaseous substance under pressure to define a stream of flow. A first contact tip receives a first feed wire. The first contact tip is oriented at an angle to the first direction to extend a distal end of the first feed wire into the stream of flow. The distal end of the first feed wire receives a power signal and serves as a first electrode. A second contact tip receives a second feed wire. The second contact tip also is oriented at an angle to the first direction and extends a distal end of the second feed wire into the stream of flow. The distal end of the second feed wire receives a power signal and serves as a second electrode. An electrical arc forms across the first electrode and second electrode melting a lead portion of the first feed wire and a lead portion of the second feed wire to form molten metal which is carried off in the flow stream.

A plurality of second nozzle ports angled relative to the first direction emit a second gaseous substance under pressure into the flow stream in the vicinity of the electrical arc. A plurality of third ports angled relative to the first direction emit a third gaseous substance under pressure into the flow stream in the vicinity of the electrical arc. The emitted first gaseous substance, second gaseous substance and third gaseous substance define a fan spray which atomizes and distributes the molten metal into a desired spray pattern. The emitted second gaseous substance and third gaseous substance cool the molten metal flowing within the fan spray. The fan spray defined by the emitted first gaseous substance, second gaseous substance and third gaseous substance uniformly distributes the molten metal. The first gaseous substance, second gaseous substance and third gaseous substance are compressed air.

The plurality of first ports include three ports in a common first plane. The plurality of second ports includes four ports. The plurality of third ports includes another four ports. The four second ports, the four third ports, the first contact tip and the second contact tip are symmetrically disposed on opposite side of the first plane.

The plurality of second ports form a nozzle oriented at a 35° angle to the first direction. Similarly, the plurality of third ports form another nozzle oriented at a 35° angle to the first direction. Such nozzle and such another nozzle are disposed symmetrically relative to such first direction and such first plane.

According to a method for arc spraying metal, gas under pressure is emitted from a first nozzle oriented in a first direction to define a stream of flow. Power is input to a first feed wire and a second feed wire, the first feed wire having a distal tip defining a first electrode, the second feed wire having a distal tip defining a second electrode. An electrical arc forms across the first and second electrode. The lead portions of the first feed wire and second feed wire melt to form molten metal. The first feed wire and the second feed wire are fed forward while arc spraying. When spraying discontinues, the feed wires are moved backward along a retraction path to prevent physical joining of the first feed wire and second feed wire. The emission of gas under pressure in the flow stream in the vicinity of the electrical arc atomizes, cools and uniformly distributes the molten metal in a fan spray pattern.

These and other aspects and advantages of the invention will be better understood by reference to the following detailed description taken in conjunction with the accompanying drawings.

DESCRIPTION OF SPECIFIC EMBODIMENTS

Overview

Figure 1:
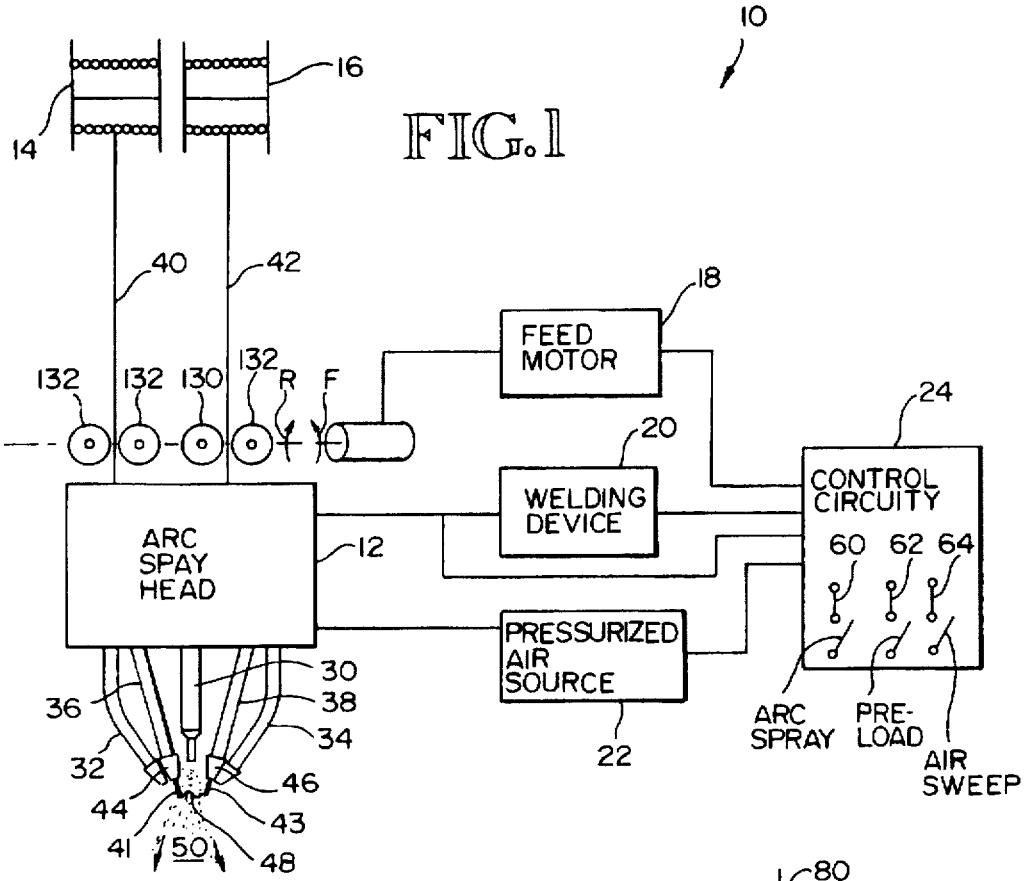
FIG. 1 is a block diagram of an arc spray system according to an embodiment of this invention.

FIG. 1 shows a block diagram of the arc spraying system 10 according to an embodiment of this invention. The function of the system 10 is to melt metal feed wire ends, atomize the molten metal and spray the metal as a coating on a given work surface. The arc spraying process continues as the consumable feed wires are fed into an arc zone. Typical metals to be sprayed include zinc, aluminum or a combination of zinc and aluminum. Spraying of other metals also is encompassed by this invention. The arc spraying system 10 includes an arc spray head 12, feed wire rolls 14, 16, a feed motor 18, a welding device 20, a pressurized source 22 of a gaseous substance (e.g., compressed air) and control circuitry 24. The arc spray head 12 includes nozzles 30, 32, 34 and feed wire sleeves 36, 38. The feed motor 18 moves a first feed wire 40 from the feed wire roll 14 into and through the feed wire sleeve 36. A distal end 41 of the wire 40 emerges at a contact tip 44 of the feed wire sleeve 36. The feed motor 18 also moves a second feed wire 42 from the feed wire roll 16 into and through the feed wire sleeve 38. A distal end 43 of the wire 42 emerges at a contact tip 46 of the feed wire sleeve 38. The welding device 20 is coupled to the arc spray head 12. The welding device 20 inputs a power signal to the contact tips 44, 46.

In one embodiment the welding device 20 is a conventional welding machine which supplies DC power at an operational voltage range of up to 50 volts and a high amperage rating up to 1,000 amps. During spraying the voltage typically is between 18 volts and 40 volts with 28 volts being a normal operating voltage level. The power signal runs through the distal ends 41, 43 of the feed wires 40, 42. Such distal ends 41, 43 serve as electrodes. The amperage of the power signal is sufficiently high for the power signal to jump across an air gap between the electrodes/distal ends 41, 43 and form an electrical arc 48. For wires having a diameter of 1/8 inch to 3/16 inch the current level is approximately 350 amps in an exemplary embodiment, and preferably is within the range of 300 to 500 amps. The feed wires 40, 42 are consumable so that their distal ends 41, 43 melt when exposed to the power signal. The wires 40, 42 are continuously or intermittently moved forward so as to maintain a source of wire to be melted at the contact tips 44, 46.

Air or another gaseous substance is applied from the pressurized source 22 to the arc spray head 12 during the arc spraying process. The gaseous substance is emitted in a high velocity stream 50 of compressed air at the nozzles 30, 32, 34. The molten metal from the feed wire distal ends 41, 43 is carried away in the stream 50 toward a given work surface to receive a metal coating. In a preferred embodiment a single source serves the nozzles 30, 32, 34. In alternative embodiments respective multiple sources are used to serve respective nozzles 30, 32, 34 or groups of nozzles. The multiple sources emit either the same or different respective gaseous substances at either the same or differing pressures.

Control circuitry 24 controls activation of the feed motor 18, welding device 20 and pressurized air source 22. The control circuitry 24 includes an arc spray switch 60, a pre-load switch 62, and an air sweep switch 64. An operator controls the position of such switches 60–64. Arc spraying occurs while the arc spray switch 60 is active. The feed motor 18, welding device 20 and pressurized air source 22 are active during arc spraying. Operations which can occur when not arc spraying include pre-loading the feed wires and air sweeping. By activating the pre-load switch 62, the feed wires 40, 42 are inched forward. When the wires ends 41, 43 reach a desired position an operator deactivates the pre-load switch 62. The welding device 20 and pressurized air source 22 are not activated by the pre-load switch 62. An air sweep function is performed by activating the air sweep switch 64. While the air sweep switch 64 is active, the pressurized air source is active to emit a stream of air through the nozzles 30, 32, 34. The feed motor 18 and welding device 20 are not activated by the air sweep switch 64. In a preferred embodiment the operator holds down one of the switches 60–64 at a given time to perform a given function.

Arc Spray Head

Figure 3:
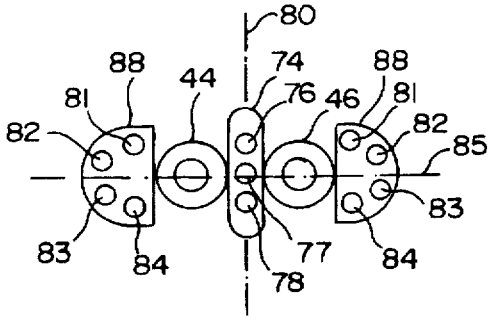
FIG. 3 is an alignment layout of the distal ends of the nozzles and contact tips of FIG. 2.
Figure 2:
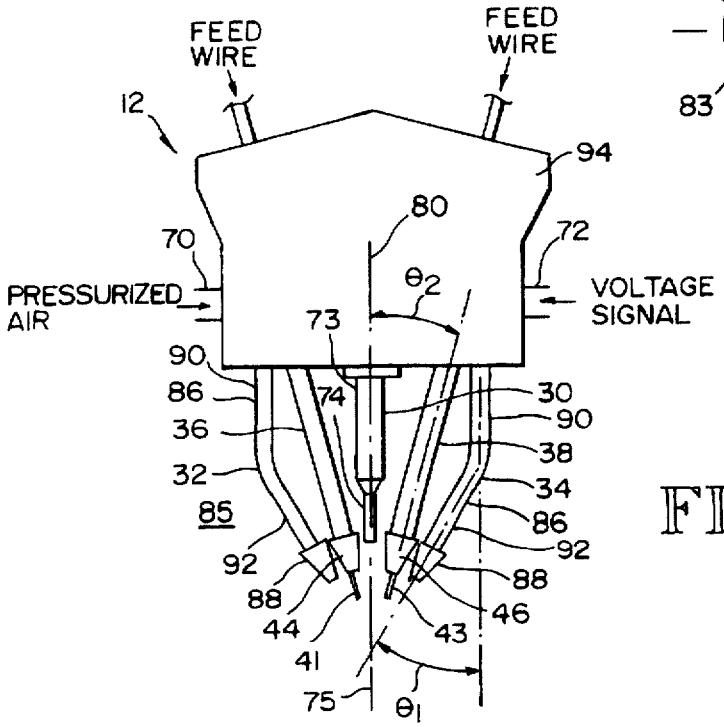
FIG. 2 is a plan view of an arc spray head of FIG. 1 according to an embodiment of this invention.

Referring to FIGS. 2 and 3, the arc spray head 12 includes a primary nozzle 30, two side nozzles 32, 34, and two feed wire sleeves 36, 38. Air or another gaseous substance under pressure is received into the arc spray head at an inlet port 70. The pressurized air is channeled to the nozzles 30–34 and emitted to create a stream of flow 50 (see FIG. 1). An electrical signal is received from the welding device 20 via an electrical connector 72. The electrical signal is applied across the contact tips 44, 46 at the end of the feed wire sleeves 36, 38 so as to form an open circuit path. Feed wires 40, 42 are fed through the feed wire sleeve 36, 38. Distal ends 41, 43 emerge from the contact tips 44, 46, respectively. The distal ends 41, 43 are in electrical communication with the contact tips 44, 46 and thus form part of the open circuit path.

The primary nozzle 30 is formed by a nozzle tube 73 and a nozzle head 74. The nozzle tube 73 extends along a first direction 75 within a plane 80. As shown in FIG. 3, the primary nozzle's nozzle head 74 includes three nozzle ports 76, 77, 78, although more or less are used in alternative embodiments. In an exemplary embodiment each nozzle port 76–78 has an inner diameter of 0.08 inch (2.03 mm), and the nozzle tube 73 has an inner diameter of 0.50 inch (12.7 mm). Preferably the nozzle ports 76–78 extend in the direction 75 (see FIG. 2) and are aligned within a common plane 80 (see FIGS. 2 and 3). In addition the nozzles 76–78 are symmetrically positioned relative to another plane 85.

Each side nozzle 32, 34 is formed by a nozzle tube 86 and a nozzle head 88. Each nozzle tube 86 includes a proximal portion 90 and a distal portion 92 relative to a housing 94 of the arc spray head 12. The proximal portion 90 of each side nozzle's nozzle tube 86 extends in the first direction 75 in parallel to the primary nozzle's nozzle tube 73. The distal portion 92 of each side nozzle's nozzle tube 86 is angled relative to the proximal portion 90. Specifically, the nozzle head 88 and the distal portion 92 of each side nozzle 32, 34 are oriented at an angle $\theta_1$ relative to the plane 80— and the direction 75 and the proximal portion 86. In the exemplary embodiment $\theta_1$ is 35°. Preferably the angle $\theta_1$ is between 20° and 45°, but may vary with alternative embodiments.

The side nozzles 32, 34 are symmetrically positioned relative to the plane 80. The nozzle head 88 for each side nozzle 32, 34 includes four nozzle ports 81, 82, 83, 84, although more or less ports are implemented in alternative embodiments. In an exemplary embodiment each nozzle port 81–84 has an inner diameter of 0.08 inch (2.03 mm), and the nozzle tube 86 has an inner diameter of 0.25 inch (6.35 mm). The nozzle ports 81–84 are symmetrically positioned relative to the alignment planes 80, 85. Planes 80. The feed wire sleeves 36, 38 and th85 are orthogonal and define two planes of symmetry for the nozzle ports 76–78, 81–84. The contact tips 44, 46 also are symmetrically positioned relative to planes 80, 85 as shown in FIGS. 2 and 3. The feed wire sleeves 36, 38 are not bent and extend out from the arc spray head housing 94 at an angle. Specifically each feed wire sleeve 36, 38 is oriented at an angle $\theta_2$ relative the plane 80 and the direction 75. In the exemplary embodiment $\theta_2$ is 15°. In preferred embodiments $\theta_2<\theta_1$. In the exemplary embodiment the nozzle head 88 and contact tip 44 are spaced at 0–1/16 inch (1.59 mm). Similarly, the nozzle head 88 and contact tip 46 are spaced at 1/16 inch. The contact tips 44, 46 are spaced 0.125 inch (3.175 mm) at their distal tips. Preferably, the distal end of the contact tips 44, 46 are located at the same distance from the housing 94 as the distal end of the nozzle heads 88 of the side nozzles 32, 34. The exemplary embodiment has been found to uniformly distribute molten metal from respective 3/16 inch (4.76 mm) diameter feed wires. In alternative embodiments the angular orientations and diameters vary.

Control Circuitry and Operation

Figure 4:
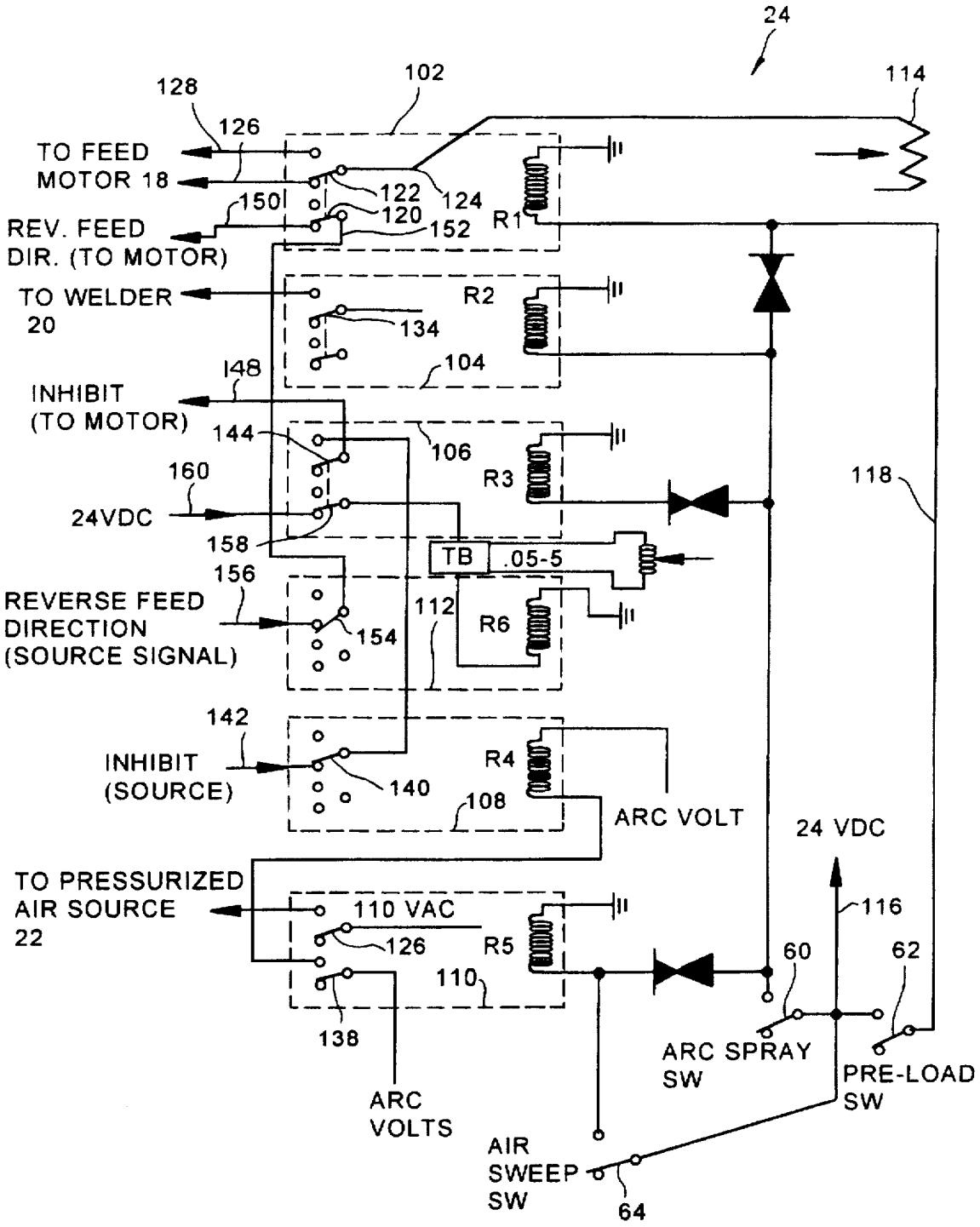
FIG. 4 is a schematic of the control circuitry of FIG. 1 in the off state for an embodiment of this invention.

Referring to FIG. 4, the control circuitry 24 includes the arc spray switch 60, the pre-load switch 62, the air sweep switch 64, several relay circuits 102, 104, 106, 108, 110, 112, and a motor speed control potentiometer 114. The circuits are described below in the context of system operating functions. FIG. 4 shows the control circuit in the off state in which none of the arc spraying, pre-loading or air sweeping functions are active.

During a pre-load operation, an operator closes the pre-load switch 62. While closed, a voltage signal from a 24 volt dc power source 116 is routed along signal path 118 and input to a relay R1 of relay circuit 102. The voltage signal energizes the relay R1 changing the state of switch 122 and switch 120. The leads 124, 126, 128 of switch 122 are coupled to the motor speed control potentiometer 114 through lead 124. When the switch 122 couples the lead 124 to lead 128 the motor 118 runs in a forward direction. Switch 120 couples leads 150 and 152 to the feed motor's inhibit circuit. With the pre-load switch 62 is activated (e.g., closed) a voltage signal energizes relay R1 causing switch 120 to open and in turn causing the feed motor's inhibit circuit to be de-activated. The feed motor 18 then runs in the forward direction so as to rotate a drive roller 130 and an idler roller 132 (see FIG. 1) for each feed roll 14, 16. The feed wires 40, 42 move forward into and through the feed wire sleeves 36, 38. An operator controls the motor speed (and thus the speed of the drive rollers 130 and idler rollers 132) by adjusting the potentiometer 114. With the pre-load switch 62 active and the arc spray switch 60 inactive and the air sweep switch 64 inactive only the first relay circuit 102 receives the voltage signal, and thus, only relay R1 is energized. When the pre-load switch 62 is de-activated (e.g., released) the relay R1 de-energizes causing the switch 120 to return to its original state (as shown in FIG. 4).

During an air sweep operation, an operator closes the air sweep switch 64. While closed, the voltage signal from the 24 volt dc power source 116 is input to a relay R5 of relay circuit 110. The voltage signal energizes the relay R5 changing the state of switch 126 so as to close a circuit path which routes a 110 volt ac signal to the pressurized air source 22. Such ac signal turns on an air valve allowing compressed air to flow into the arc spray head 12 and out through the nozzles 30, 32, 34. With the air sweep switch 64 active and the arc spray switch 60 inactive and the pre-load switch 62 inactive only the relay circuit 110 receives the 24 v dc voltage signal, and thus, only relay R5 is energized. When the air sweep switch 64 is released the relay R5 de-energizes causing the switch 126 to return to its original state (as shown in FIG. 4). In response the valve at the pressurized air source 22 closes shutting off air flow to the arc spray head 12.

Figure 5:
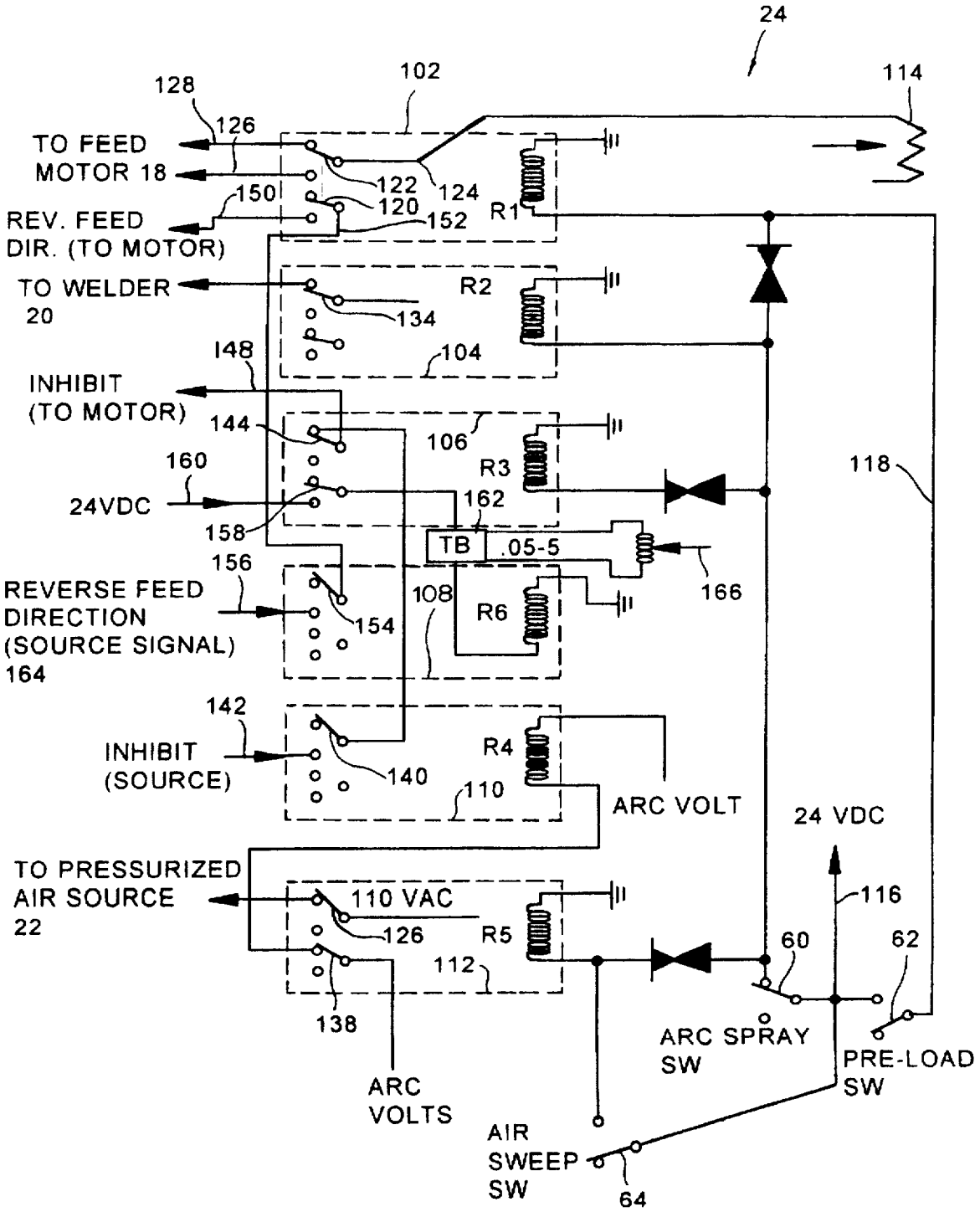
FIG. 5 is a schematic of the control circuitry of FIG. 4 during an arc spray operation; and FIGS. *6a*, *6b*, *6c* are planar diagrams depicting various steps in an arc spraying process according to an embodiment of this invention.

During arc spraying, an operator closes the arc spray switch 60. While closed, the voltage signal from the 24 volt dc power source is input to relays R1, R2, R3 and R5 of relay circuits 102, 104, 106, 110, respectively. The voltage signal energizes relay R1 causing the feed motor 18 to engage the rollers 130, 132 and move the feed wires 40, 42 forward. The voltage signal also energizes relay R5 causing the pressurized air source 22 to open its air valve and release air under pressure into the arc spray head 12 for emission via nozzles 30, 32, 34. In addition, the voltage signal energizes relay R2 changing the state of switch 134 so as to turn on power to the welding device 20. With the welding device 20 powered, the 35 volt dc, high amperage power signal is input from the welding device 20 to the arc spray head 12. The power signal defines an open circuit across the electrodes defined by the ends 41, 43 of the feed wires 40, 42. The power signal, however, has sufficient amperage to form an electrical arc 48 across the electrodes and melt the wire ends 41, 43. With the motor 118 engaging the rollers 30, 132, the feed wires are moved forward continuously while the ends are consumed. The molten metal from the melted ends 41, 43 is moved off in the stream of flow from the air emitted by the nozzles 30, 32, 34. FIG. 5 shows the control circuitry 24 state for normal arc spraying while the arc spray switch 60 is active.

Arc Shorting Control

The control circuitry 24 also embodies an arc shorting control system. When the electrodes at the arc spray head begin to short, there is a drop in voltage across the electrodes. Initially a voltage potential of 35 volts occurs for a 35 volt high amperage signal fed from the welding device 20. When an electrical arc bridges the electrodes, the voltage drops. When the electrodes begin to short the voltage drops further. Such further drop in voltage is detected to avoid damage to the arc spray system 10. Specifically, once detected feeding of the wires 40, 42 discontinues until the voltage increases to a prescribed level. The arc shorting control system is implemented by the relay circuits 106, 108, 110. Relay circuit 106 includes a relay R3 and a normally open switch 144. Relay circuit 108 includes a relay R4 and a normally closed switch 140. Relay circuit 110 includes the relay R5 and a normally open switch 138.

With the arc spray switch 60 active, relays R3 and R5 are energized. The energized relay R3 causes switch 144 to change state from its normally open state to a closed state. The relay R5 when energized changes the state of switch 138 from an open path to a closed path. One lead of switch 138 is coupled to one line of the welding device 20 power signal fed to the arc spray head 12 (e.g., path leading to one of the electrodes). The other lead of switch 138 is coupled to relay R4 of relay circuit 108. The relay R4 also is coupled to the other line of the welding device 20 power signal (e.g., path leading to the other electrode). When relay R5 is energized closing switch 138, the relay R4 serves as a sensor to detect the arc voltage, and more specifically to detect when the electrodes are beginning to short. In one embodiment the relay R4 becomes energized when a voltage difference of 18 volts occurs across its leads. With the arc spraying process active, the voltage difference is approximately 35 volts (e.g., the voltage of the power signal fed from the welding device 20 to the arc spray head 12 electrodes). Thus, the relay R4 is normally energized during arc spraying. When relay R4 is energized the state of switch 140 of relay circuit 108 changes to an open state as shown in FIG. 5. When the arc voltage drops down to 15 volts, however, the relay R4 de-energizes causing the switch 140 to return to its normally closed state (of FIG. 4). Such drop in voltage is due to a shorting of the arc spray head electrodes. Before the electrodes fuse and short completely potentially damaging the arc spray system 10, an inhibit signal 142 is coupled to the feed motor 18 to stop feeding the wires 40, 42. Specifically a circuit path is defined coupling a source inhibit signal 142 through switch 140 and switch 144 to define an output inhibit signal 148 routed to the feed motor 18. While wire feeding has discontinued, the feed wire ends 41, 43 continue to melt from the residual heat. As a result, the voltage soon goes back up to 18 volts re-energizing the relay R4 and decoupling the inhibit signal so that wires 40, 42 resume feeding into the arc spray head 12.

Backing Up Feed Wires

When the arc spray switch 60 is released (deactivated), power to the welder device 20 is discontinued. In addition the air valve at the pressurized air source is closed and the feed motor 18 stops moving the feed wires 40, 42 forward. Thus, arc spraying ceases. Specifically, the arc voltage drops to zero causing the arc across the electrodes to go away, and the air stream emitted from nozzles 30, 32, 34 ceases. It has been found that at times the feed wire ends 41, 43 fuse together when arc spraying is discontinued. When the arc voltage terminates and the wire ends 41, 43 cool/harden, the wire ends at times extend to an intersection where the wire ends 41, 43 physically join. Such joining is an electrical short. Conventionally, such short was tolerated because when arc spraying started, the fused area would be blasted away by the arc voltage signal and the air stream before damage occurred to the arc spray system 10. With feed wires having larger than conventional diameters (e.g., >⅛ inch diameter), however, the wire resistance is too great for the fused area to be immediately blasted away. As a result, the short across the electrodes can damage the arc spray system 10, and in particular melt the contact tips 44, 46. Thus, to avoid such fusing, the feed wires are moved backward for a prescribed time period upon discontinuing the arc spraying process.

The feed wires 40, 42 are moved back by changing the direction which the feed motor 18 rotates the drive rollers 130 and idler rollers 132. Referring again to FIGS. 4 and 5, relay circuits 102, 106, and 108 serve to control backing up of the feed wires 40, 42. Relay circuit 102 includes a switch 122. One lead 126 of the switch 122 is coupled to the feed motor 18. When the switch 122 is closed, lead 126 is coupled to lead 124 causing an electrical signal which serves to reverse the feed direction to be coupled to the feed motor 118. Relay circuit 106 includes a normally closed switch 158. While closed switch 158 couples a 24 volt dc signal to a timing board 162.

When the arc spray switch 60 is activated relay R1 energizes, switch 122 breaks the circuit connection between leads 124 and 126 and establishes a connection between leads 124 and 128 causing the feed motor 118 to drive the rollers 130, 132 so as to feed wire in the default forward direction. In addition relay R3 opens the switch 158 decoupling the 24 volt dc signal from the timer board 162. When the arc spray switch 60 is deactivated, relay R1 is de-energized causing switch 122 to break the connection between leads 124, 128 and establish a connection between leads 124, 126. This causes the reverse directions and drive the rollers 130, 132 so as to back up the feed wires. With switch 60 de-activated, relay R3 closes switch 158 coupling the 24 volt dc signal 160 to the timing board 162. After a specified time delay, the timer board passes the 24 volt dc signal to relay R6 of relay circuit 108 energizing relay R6. With R6 energized, switch 154 closes stopping the feed motor 18 and rollers 130, 132.

The timer board 162 includes an input enabling the operator to control the amount of time for backing up the feed wire. In one embodiment a potentiometer 166 is adjustable by the operator to control the back up period. Once the time expires the timer board passes the 24 volt dc signal 160 to relay R6. Thus, relay R6 energizes causing switch 154 to close, causing the motor 18 to stop reverse feeding the wires 40, 42. As a result, whenever the arc spray switch 60 is released, the feed wires 40, 42 are backed up for an adjustable time period.

Arc Spray Method

Figure 6A:
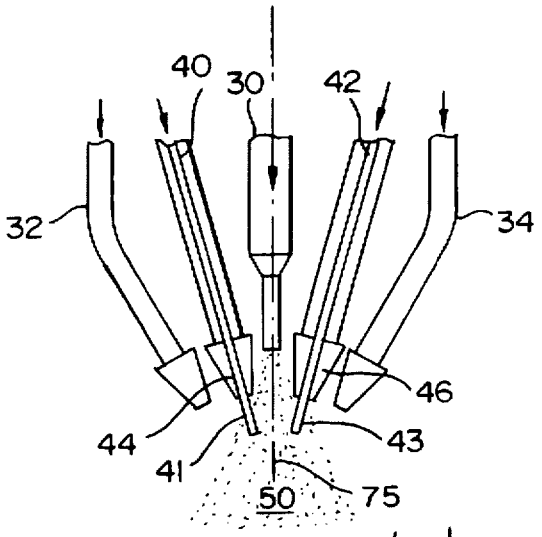
Figure 6B:
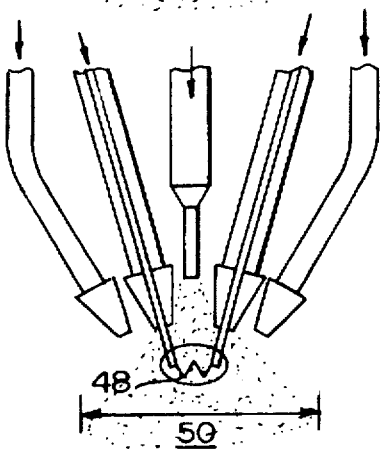
Figure 6C:
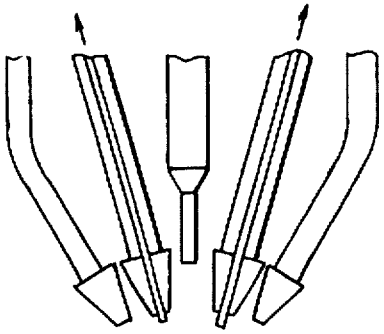

Referring to FIGS. 6*a*–6*c*, feed wires 40, 42 a gas under pressure (e.g., compressed air) is emitted from the primary nozzle 30. The nozzle 30 is oriented in a first direction 75 to define a stream of flow 170. A power signal is coupled to distal ends 41, 43 of a first feed wire 40 and a second feed wire 42, respectively. The distal end 41 of the first feed wire 40 serves as a first electrode. The distal end 43 of the second feed wire 42 serves as a second electrode. An open circuit occurs across the electrodes (see FIG. 6*a*). The power signal, however, has sufficient amperage to form an electrical arc 48 across the first and second electrodes (see FIG. 6*b*), during which lead portions of the first feed wire 40 and second feed wire 42 melt to form molten metal. The electrical arc 48 occurs at least in part within the flow stream 170. The molten metal enters the flow stream 170. The distal portions of the feed wires 40, 42 are consumed during the arc spraying process. As the distal portions melt, the feed wires 40, 42 are fed forward.

Respective side nozzles 32, 34 include multiple nozzle ports 81–84 for emitting the gas under pressure. The nozzle ports are angled relative to the first direction 75 and emit the gas under pressure into the flow stream 170 in the vicinity of the electrical arc 48 to define a fan spray pattern 50. The flow stream from the primary nozzle 30 and the side nozzles 32, 34 cools, atomizes and uniformly distributes the molten metal within the fan spray pattern 50. The nozzle ports of the primary nozzle 30 and the side nozzles 32, 34, along with the contact tips 44, 46 for holding the feed wire ends 41, 43 are symmetrically positioned relative to two orthogonal planes 80, 85 (see FIGS. 2, 3).

Upon discontinuation of the arc voltage signal and the gas emission, the feed wires 40, 42 are retracted in part to prevent physical joining/fusing of the first feed wire 40 and second feed wire 42 (see FIG. 6*c*).

Following are exemplary results for arc spraying wires with the exemplary embodiment described above. One-eighth inch diameter zinc wire arc sprayed at 350 amps results in a spray rate of approximately 80 lbs. per hour with a deposition efficiency of approximately 50%–55%. One-eighth inch diameter zinc wire arc sprayed at 500 amps results in a spray rate of approximately 100 lbs. per with approximately the same deposition efficiency. Thus, the spray rate increases from 80 to 100 lbs. per hour as current is increased from 350 to 500 amps.

Three-sixteenths inch diameter zinc wire arc sprayed at 350 amps results in a spray rate of approximately 150 lbs. per hour with a deposition efficiency of approximately 65%–70%. Three-sixteenths inch diameter zinc wire arc sprayed at 500 amps results in a spray rate of approximately 200 lbs. per with approximately the same deposition efficiency. Thus, the spray rate increases from 150 to 200 lbs. per hour as current is increased from 350 to 500 amps. Note that the arc spraying rate approximately doubled when the diameter was increased from ⅛ inch to 3/16 inch. Even more significantly, and surprisingly, the deposition efficiency improves by approximately 15%.

One-eighth inch diameter aluminum wire arc sprayed at 350 amps results in a spray rate of approximately 28 lbs. per hour with a deposition efficiency of approximately 50%–55%. Three-sixteenths inch diameter aluminum wire arc sprayed at 350 amps results in a spray rate of approximately 35 lbs. per hour with a deposition efficiency of approximately 65%–70%. Thus, the spray rate increases from 28 to 35 lbs. per hour when the diameter was increased from ⅛ inch to 3/16 inch. Even more significantly, and surprisingly, the deposition efficiency improves by approximately 15%. Note that the rates are less for aluminum than for zinc, at least in part, because aluminum wire weighs 0.1 lbs./in$^3$ whereas zinc wire weighs 0.28 lbs./in$^3$.

Meritorious and Advantageous Effects

One advantage of the invention is improved deposition efficiency and effectiveness. The side nozzles 32, 34 enable uniform distribution of molten metal. For larger diameter wires uniform distribution enables an increased deposition rate and a larger spray pattern. Another advantage is that a safety feature is added by reversing the feed wires upon discontinuing the arc spraying process.

Although a preferred embodiment of the invention has been illustrated and described, various alternatives, modifications and equivalents may be used. For example, although diameters, angles and numbers of nozzle ports are described for an exemplary embodiment, such values may vary for differing embodiments. Similarly, although voltage values are given for an exemplary embodiment, such voltages may vary. Exemplary wire diameters include 2 mm, 4.0 mm, 4.8 mm, ⅛ inch, 3/16 inch and 5/32 inch. Therefore, the foregoing description should not be taken as limiting the scope of the inventions which are defined by the appended claims.

What is claimed is:

1. An arc spray head, comprising:

a plurality of first ports oriented in a first direction for emitting a first gaseous substance under pressure to define a stream of flow;

a first contact tip receiving a first feed wire, the first contact tip oriented at an angle to the first direction to extend a distal end of the first feed wire into the flow stream, wherein the distal end of the first feed wire receives a power signal and serves as a first electrode, the first feed wire comprising metal;

a second contact tip receiving a second feed wire, the second contact tip oriented at an angle to the first direction to extend a distal end of the second feed wire into the flow stream, wherein the distal end of the second feed wire receives a power signal and serves as a second electrode, the second feed wire comprising metal;

wherein the first feed wire and second feed wire each have a diameter greater than ⅛ inch and wherein an electrical arc is formed across the first electrode and second electrode by a sower signal having an amperage of not more than 500 amps melting a lead portion of the first feed wire and a lead portion of the second feed wire to form molten metal which is carried off in the flow stream;

a plurality of second ports angled relative to the first direction for emitting a second gaseous substance under pressure into the flow stream in the vicinity of the electrical arc; and a plurality of third ports angled relative to the first direction for emitting a third gaseous substance under pressure into the flow stream in the vicinity of the electrical arc;

wherein the emitted first gaseous substance, second gaseous substance and third gaseous substance define a fan spray which atomizes, cools and uniformly distributes the molten metal into a spray pattern.

2. The head of claim 1, in which the plurality of second ports form a nozzle oriented at a first angle to the first direction within the range of 20° to 45°, and in which the plurality of third ports form another nozzle oriented at a second angle to the first direction within the range 20° to 45°, and in which said nozzle and said another nozzle are disposed symmetrically relative to said first direction.

3. The head of claim 2, in which the first contact tip is oriented at an angle to the first direction which is less than the first angle, in which the second contact tip is oriented at an angle to the first direction which is less than the second angle, and in which the first contact tip and second contact tip are disposed symmetrically relative to said first direction.

4. The head of claim 2, in which the plurality of first ports comprises three ports in a common first plane, in which the plurality of second ports comprises four ports, and in which the plurality of third ports comprises four ports, and wherein the four second ports, the four third ports, the first contact tip and the second contact tip are symmetrically disposed on opposite side of the first plane.

5. The head of claim 1, in which the plurality of second ports form a nozzle oriented at a first angle to the first direction of at least 30°, and in which the plurality of third ports form another nozzle oriented at a second angle to the first direction of at least 30°, and in which said nozzle and said another nozzle are disposed symmetrically relative to said first direction.

6. An arc spray system, comprising:

a first feed wire comprising metal;

a second feed wire comprising metal;

an arc spray head receiving the first feed wire, the second feed wire, a gaseous substance, and an electrical signal, wherein the electrical signal is received into a distal end of the first feed wire to define a first electrode and wherein the electrical signal is received into a distal end of the second feed wire to define a second electrode, wherein an electrical arc forms across the first electrode and second electrode melting a lead portion of the first feed wire and a lead portion of the second feed wire to form molten metal, and wherein the gaseous substance is emitted to define a flow stream which sprays the molten metal;

a first motor for actuating movement of the first feed wire; and a second motor rotating in either one of a forward rotation direction or a reverse rotation direction, the second motor actuating movement of the second feed wire in a forward direction within the spray head during spraying of the molten metal while the second motor rotates in the forward rotation direction, and the second motor actuating movement of the second feed wire in another direction upon discontinuation of spraying while the second motor rotates in the reverse rotation direction, wherein said movement of the second feed wire in said another direction prevents physical joining of the first feed wire and second feed wire during the discontinuation of spraying.

7. The system of claim 6, further comprising a switch having a first state during which spraying occurs and a second state during which spraying discontinues, and wherein actuation by the second motor changes from the forward rotation direction to said reverse rotation direction in response to a state change of the switch from the first state to the second state.

8. The system of claim 6, in which the first motor and second motor comprise a common motor, wherein the common motor actuates movement of the first feed wire and the second feed wire in said forward direction within the spray head during spraying of the molten metal while the common motor rotates in the forward rotation direction, and the common motor actuates movement of the first feed wire and the second feed wire in said another direction upon discontinuation of spraying while the common motor rotates in the reverse rotation direction, wherein said movement of the first feed wire and the second feed wire in said another direction prevents physical joining of the first feed wire and second feed wire during the discontinuation of spraying.

9. The system of claim 6, in which the arc spray head comprises:

a plurality of first ports oriented in a first direction for emitting the gaseous substance under pressure to define a stream of flow;

a first contact tip receiving the first feed wire, the first contact tip oriented at an angle to the first direction to extend a distal end of the first feed wire into the flow stream;

a second contact tip receiving the second feed wire, the second contact tip oriented at an angle to the first direction to extend a distal end of the second feed wire into the flow stream;

a plurality of second ports angled relative to the first direction for emitting the gaseous substance under pressure into the flow stream in the vicinity of the electrical arc; and a plurality of third ports angled relative to the first direction for emitting the gaseous substance under pressure into the flow stream in the vicinity of the electrical arc; and wherein the emitted gaseous substance defines a fan spray which atomizes, cools and uniformly distributes the molten metal into a spray pattern.

10. The system of claim 9, in which the plurality of second ports form a nozzle oriented at a first angle to the first direction which is at least 20°, and in which the plurality of third ports form another nozzle oriented at a second angle to the first direction which is at least 20°, and in which said nozzle and said another nozzle are disposed symmetrically relative to said first direction; and wherein the first contact tip is oriented at an angle to the first direction which is less than the first angle, in which the second contact tip is oriented at an angle to the first direction which is less than the second angle, and in which the first contact tip and second contact tip are disposed symmetrically relative to said first direction.

11. The system of claim 9, in which the first feed wire and second feed wire each have a diameter greater than ⅛ inch, and in which the electrical arc is formed by a power signal having an amperage of not more than 500 amps.

12. A method for arc spraying metal, comprising the steps of:

emitting gas under pressure from a first nozzle oriented in a first direction to define a stream of flow;

inputting electrical current into a first feed wire and a second feed wire, the first feed wire having a distal tip defining a first electrode, the second feed wire having a distal tip defining a second electrode;

forming an electrical arc across the first and second electrode during which lead portions of the first feed wire and second feed wire melt to form molten metal, wherein the electrical arc occurs at least in part within the flow stream, and wherein the molten metal enters the flow stream;

feeding the first feed wire forward during the steps of emitting, inputting and forming;

feeding the second feed wire forward during the steps of emitting, inputting and forming;

discontinuing the steps of inputting and forming; and moving the first wire along a retraction path after said step of discontinuing to prevent physical joining of the first feed wire and second feed wire while said steps of inputting and forming are discontinued.

13. The method of claim 12, further comprising the step of emitting the gas under pressure into the flow stream in the vicinity of the electrical arc to define a fan spray which atomizes, cools and uniformly distributes the molten metal into a spray pattern.

14. The method of claim 13, in which the gas under pressure emitted in the vicinity from the electrical arc is emitted from a second nozzle and a third nozzle symmetrically disposed relative to the first nozzle.

15. The method of claim 14, in which the second nozzle is oriented at an angle of 20° to 45° relative to the first nozzle, in which the third nozzle is oriented at an angle of 20° to 45° relative to the first nozzle.

16. A method for arc spraying metal, comprising the steps of:

emitting gas under pressure from a first nozzle oriented in a first direction to define a stream of flow;

inputting electrical current having an amperage of not more than 500 amps into a first feed wire having a diameter greater than ⅛ inch and a second feed wire having a diameter greater than ⅛ inch, the first feed wire having a distal tip defining a first electrode, the second feed wire having a distal tip defining a second electrode;

forming an electrical arc across the first and second electrode during which lead portions of the first feed wire and second feed wire melt to form molten metal, wherein the electrical arc occurs at least in part within the flow stream, and wherein the molten metal enters the flow stream;

emitting gas under pressure from a second nozzle and a third nozzle symmetrically disposed relative to the first nozzle into the flow stream in the vicinity of the electrical arc to define a fan spray which atomizes, cools and uniformly distributes the molten metal into a spray pattern; and feeding the first feed wire and second feed wire forward.

17. The method of claim 16, in which the electrical arc is formed by a power signal having an amperage of not more than 400 amps.

18. The method of claim 16, in which the first feed wire and second feed wire each have a diameter of at least 3/16 inch.

19. The method of claim 16, in which the electrical arc is formed by a power signal having an amperage of not more than 400 amps.

20. The method of claim 16, wherein the second nozzle is oriented at an angle of 20° to 45° relative to the first nozzle, in which the third nozzle is oriented at an angle of 20° to 45° relative to the first nozzle.

21. An arc spray head, comprising:

a plurality of first ports oriented in a first direction for emitting a first gaseous substance under pressure to define a stream of flow;

a first contact tip receiving a first feed wire, the first contact tip oriented at an angle to the first direction to extend a distal end of the first feed wire into the flow stream,wherein the distal end of the first feed wire receives a power signal and serves as a first electrode, the first feed wire comprising metal;

a second contact tip receiving a second feed wire, the second contact tip oriented at an angle to the first direction to extend a distal end of the second feed wire into the flow stream, wherein the distal end of the second feed wire receives a power signal and serves as a second electrode, the second feed wire comprising metal;

wherein the first feed wire and second feed wire each have a diameter greater than ⅛ inch and wherein an electrical arc is formed across the first electrode and second electrode by a power signal having an amperage melting a lead portion of the first feed wire and a lead portion of the second feed wire to form molten metal which is carried off in the flow stream;

a plurality of second ports angled relative to the first direction for emitting a second gaseous substance under pressure into the flow stream in the vicinity of the electrical arc; and a plurality of third ports angled relative to the first direction for emitting a third gaseous substance under pressure into the flow stream in the vicinity of the electrical arc;

wherein the emitted first gaseous substance, second gaseous substance and third gaseous substance define a fan spray which atomizes, cools and uniformly distributes the molten metal into a spray pattern.

* * * * *